United States Patent [19]

Rangel

[11] Patent Number: 5,020,633

[45] Date of Patent: Jun. 4, 1991

[54] EMERGENCY ESCAPE DEVICE

[76] Inventor: Louis R. Rangel, 3104 Minnehaha Ave. S., Minneapolis, Minn. 55406

[21] Appl. No.: 479,382

[22] Filed: Feb. 13, 1990

[51] Int. Cl.[5] ..... E06C 9/14; E06C 1/56

[52] U.S. Cl. ..... 182/70; 182/100; 182/190

[58] Field of Search ..... 182/70, 76, 100, 190, 182/196

[56] References Cited

U.S. PATENT DOCUMENTS

| | | | |
|---|---|---|---|
| 283,439 | 8/1883 | Torst | 182/70 |
| 294,360 | 3/1884 | Borgfeldt | 182/190 |
| 299,850 | 6/1884 | Rensch | 182/190 |
| 412,630 | 10/1889 | Klipp | 182/76 |
| 1,612,126 | 12/1926 | James | 182/70 |
| 3,677,366 | 7/1972 | Loeffel | 182/70 |
| 4,381,046 | 4/1983 | Landem | 182/196 |

*Primary Examiner*—Reinaldo P. Machado
*Attorney, Agent, or Firm*—Dorsey & Whitney

[57] ABSTRACT

An emergency escape device in the form of a flexible strap- or rope-like support attached to an enclosure installed on an inside building wall beneath a window is disclosed. When the device is not in use, the flexible support is housed within the enclosure, which is designed to blend aesthetically with the decor of the window and the inside building wall. When in use, the flexible support is designed to extend from the interior of the enclosure, over the windowsill, and down the outside building wall. The proximal end of the flexible support is composed of fireproof steel cable or chain of sufficient length to extend from its point of attachment within the enclosure to the outside building wall. The flexible support may be provided with gripping areas and/or an adjustable harness to facilitate descent to a lower level window or to ground level.

2 Claims, 4 Drawing Sheets

EMERGENCY ESCAPE DEVICE

BACKGROUND OF THE INVENTION

This invention relates to an emergency escape device, more particularly to a flexible support affixed to the inside of an enclosure installed on an inside building wall beneath a pre-existing window.

Flexible emergency escape devices used in conjunction with a window are known in the prior art. U.S. Pat. No. 639,902 discloses a window casing modified to contain a flexible wire and pipe ladder attached to a frame that can be extended over the windowsill to the building exterior. U.S. Pat. No. 1,397,643 discloses a window casing modified to contain a system of cables engaged by pulleys allowing escape over the windowsill and down the exterior building wall. The ladders and cables of these inventions are substantially different from the flexible and compact support of the present invention, the enclosure of which can be attached to a pre-existing window area, yet firmly held in conjunction therewith. U.S. Pat. No. 654,415 discloses a reel and rope assembly for attachment to an inside or outside building wall. The manner of attachment of this device and the method of storage and deployment of the flexible support are substantially different from the present invention. Neither is the device designed to blend in with the interior building decor, as is the present invention. U.S. Pat. No. 4,445,589 discloses a window assembly including a storable fire escape ladder. The patent shows a manner of access to the ladder portion substantially different from the present invention, and requires the use of a specially designed window. U.S. Pat. No. 4,161,998 discloses a flexible rope-like support with four-to-five-inch-diameter beads spaced axially along substantially the entire length of the support. The patent disclosure suggests storage of the support in a transparent bag attached to a building room wall. None of these patents shows the use of a fire-resistant chain portion as used in the present invention.

SUMMARY OF THE INVENTION

An enclosure is provided for installation on an interior building wall below a window frame so as to aesthetically blend with the decor of the window and interior wall. The front of the enclosure is hinged to allow access to the enclosure interior, which houses a flexible rope- or strap-like support wound, folded, or otherwise packaged within the enclosure. The proximal end of the flexible support, affixed to the interior structure of the enclosure, is composed of fire-resistant steel cable or chain of sufficient length to reach the outside building wall. When it is desired to escape from the building in which the enclosure is installed, the enclosure is opened by pivoting open the enclosure front. The flexible support is removed from the enclosure and dropped through the window, previously opened, down the exterior building wall, allowing egress from the building interior to a lower level window or to ground level.

In a preferred embodiment, the enclosure is lined with a rigid, fire-proof aluminum box.

In another embodiment, the flexible support is doubled back upon itself at regular intervals to provide gripping areas facilitating controlled descent along the flexible support.

In another embodiment, the distal end of the flexible support is provided with an adjustable harness allowing infants, elderly, and disabled persons to be lowered to safety by a person or persons in the building.

It can be seen that the invention provides a readily installed, functional, and inexpensive emergency escape device with aesthetic qualities.

DETAILED DESCRIPTION OF THE INVENTION

Although it is probable that the present invention will be used primarily as a fire escape device, the invention is termed an emergency escape device so as to encompass the full range of its intended use.

Figure 1:
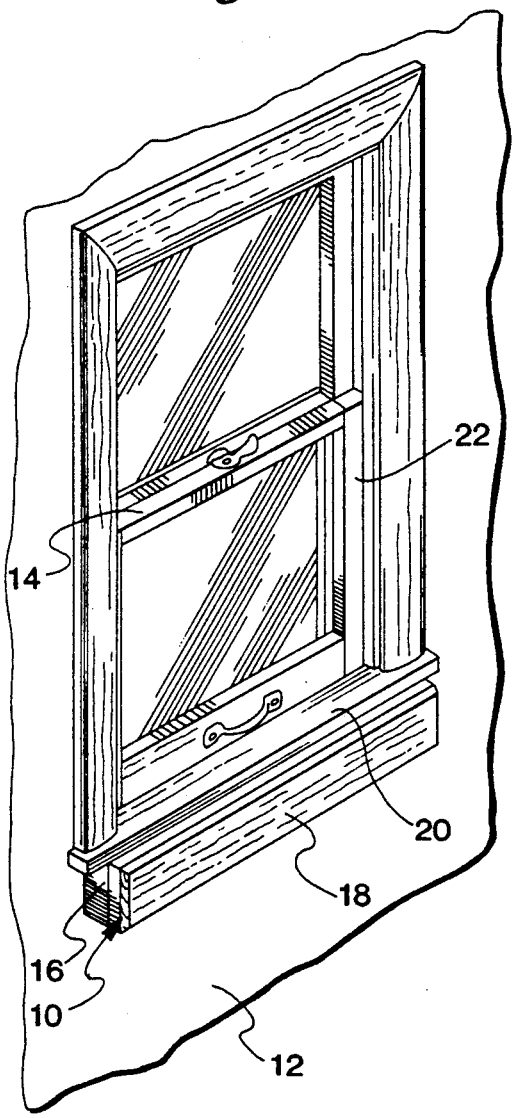
FIG. 1 illustrates the enclosure of the present invention, in a closed position, installed beneath a typical double-hung window.

Referring now to FIG. 1 of the appended drawings, the emergency escape device, generally designated by the number 10, is shown installed on an inside building wall 12 below a window 14 situated within the building wall 12. As shown in FIG. 1, the invention comprises in part an enclosure 16 with pivoted front 18 facing the building interior. In a preferred embodiment of the invention, shown in FIG. 1, the enclosure 16 is installed directly beneath and abutting the windowsill 20 of the window 14 so as to aesthetically blend with the decor of the window 14 and inside building wall 12. As shown in FIG. 1, it is desirable that the horizontal distance spanned by the enclosure is greater than the distance from the left inner edge to the right inner edge of the window frame 22, to assist in preventing movement of the enclosure 16 through the window 14. The enclosure 16 may be made of wood or other suitable material.

Figure 2:
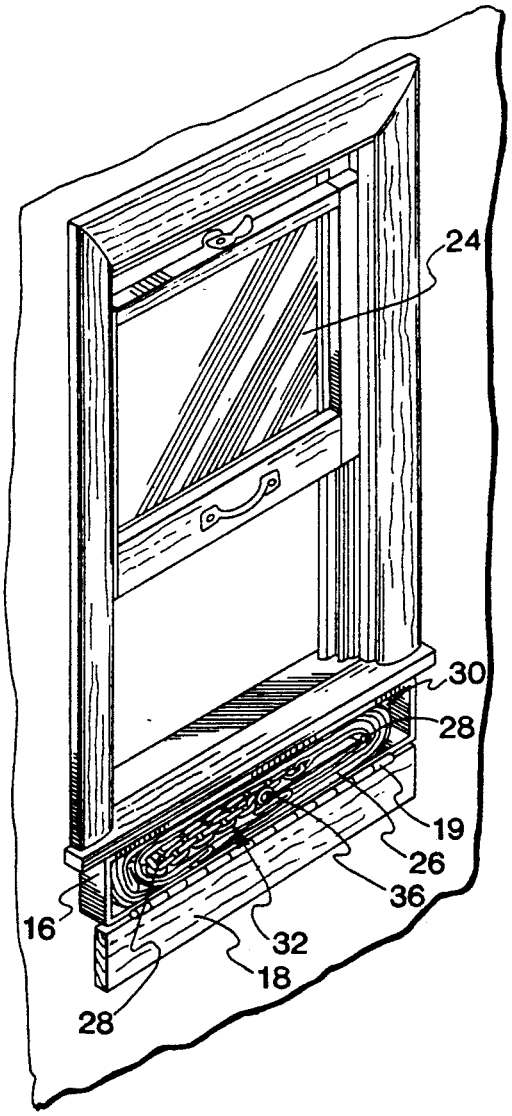
FIG. 2 is a view similar to that of FIG. 1, with window sash open/and the front of the enclosure pivoted downward revealing the housed flexible support.
Figure 4:
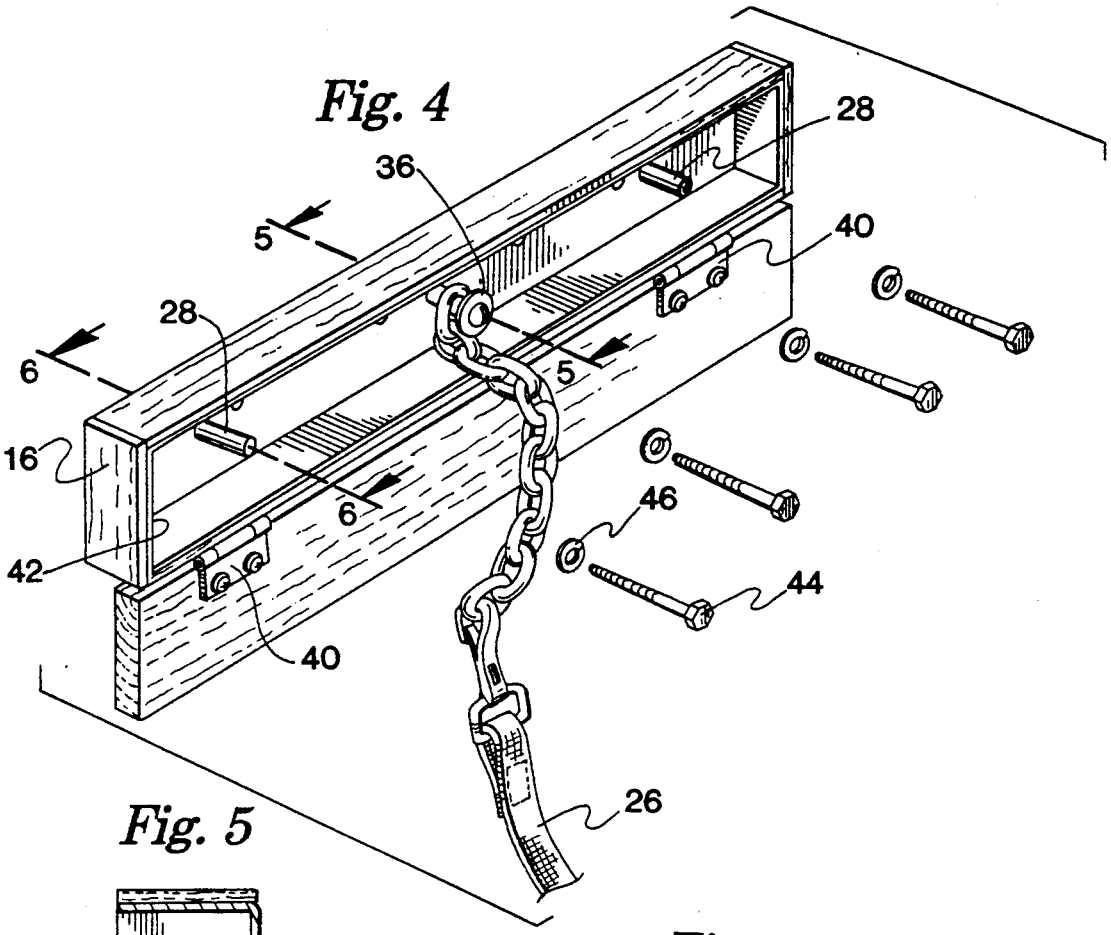
FIG. 4 is an illustration of an embodiment of the invention showing enclosure interior with embedded aluminum box and structure and positions of posts and fasteners.

FIG. 2 shows the front 18 of the enclosure 16 in an open position, having been pivoted downward about a continuous hinge 19, from the closed position shown in FIG. 1. The front 18 also could be pivoted about spaced simple hinges 40 as shown in FIG. 4. The inner sash 24 of the window 14 is shown in the open position in FIG. 2, as the sash 24 would be opened in an emergency situation to allow egress of a person or persons to the building exterior. An elongated flexible strap-like support 26 is shown housed within the enclosure 16 by being wound around spaced posts 28 affixed to the interior back wall 30 of the enclosure 16. The flexible support also could be composed of rope-like material and could be housed in the enclosure 16 by winding, folding, or other means for packaging a flexible support within the enclosure 16. In the embodiment shown in FIG. 2, the proximal end 32 of the flexible support 26 is composed of fire-proof steel chain 34 attached to a binding post 36 affixed to the middle portion of the interior back wall 30 of the enclosure 16. The proximal end of the flexible support also could be composed of fire-proof steel cable, and could be affixed to any convenient structure within the enclosure 16.

Figure 3:
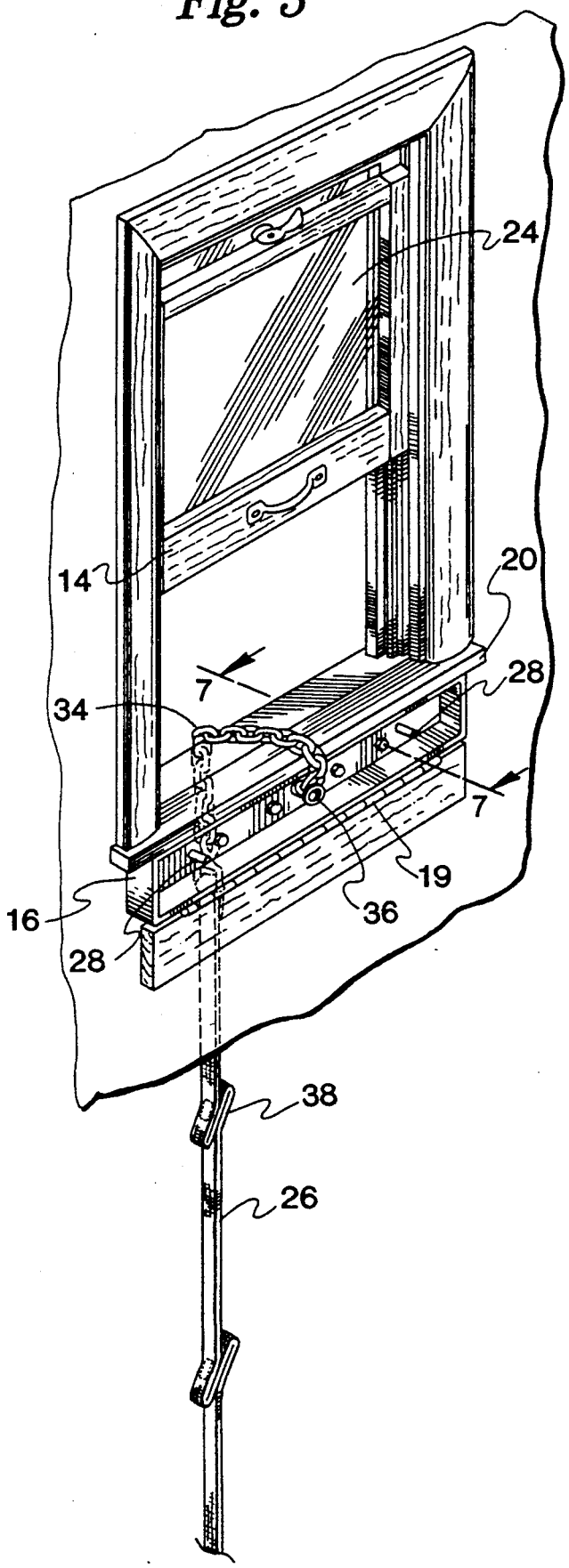
FIG. 3 is a view similar to that of FIG. 2 showing typical deployment of the flexible support over the windowsill to the building exterior.

FIG. 3 shows the flexible support 26 deployed over the windowsill 20 to the building exterior. This could have been accomplished, for example, by grasping the housed flexible support 26 as shown in FIG. 2, pulling out of the enclosure 16, and throwing through the open window 14 over the windowsill 20 to the building exterior. A person or persons could then exit the building interior by, for example, stepping through the open window 14 and climbing down the flexible support 26 to a lower level window or to ground level. In a preferred embodiment shown in FIG. 3, the flexible support 26 is provided with gripping areas 38 formed, for example, by doubling the flexible strap-like support 26 back upon itself at regular intervals.

FIG. 4 illustrates an embodiment in which the enclosure interior is lined by an embedded aluminum plate box 42, to provide fire-proof support and rigidity to the enclosure 16. FIG. 4 shows the flexible support 26 in a semi-deployed position, having been removed from the enclosure but not yet positioned to extend over the windowsill to the building exterior. The embodiment shown in FIG. 4 shows the preferred relative positions of the spaced posts 28 for support of the wound flexible support when stored within the enclosure. FIG. 4 also shows one mode of attachment of the chain 34 portion of the proximal end 32 of the flexible support 26 to a center binding post 36. Means comprising lag screws 44 and lock washers 46 for attachment of the enclosure 16 to the interior building wall are also shown in the embodiment illustrated in FIG. 4.

Figure 5:
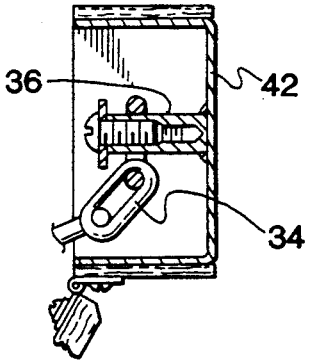
FIG. 5 is a cross-sectional view taken along line 5—5 in FIG. 4.

FIG. 5 is a fragmentary cross-sectional view of the embodiment illustrated in FIG. 4, showing one possible mode of attachment of the chain 34 to a center binding post 36.

Figure 6:
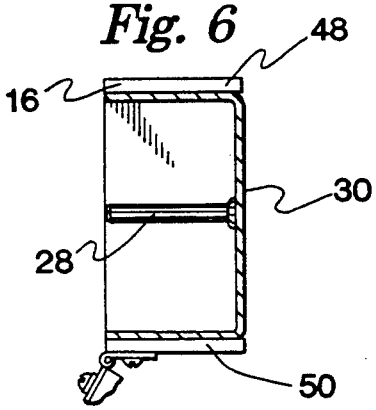
FIG. 6 is a cross-sectional view taken along line 6—6 in FIG. 4.

FIG. 6 is a fragmentary cross-sectional view of the embodiment illustrated in FIG. 4, showing the preferred placement of a spaced post 28 on the back wall 30 of the enclosure 16, approximately mid-way between the top 48 and bottom 50 of the enclosure 16.

Figure 7:
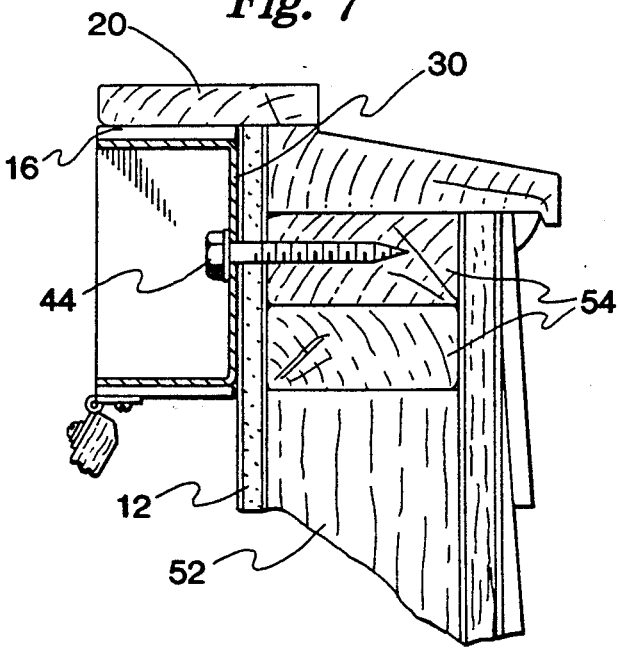
FIG. 7 is a cross-sectional view taken along line 7—7 in FIG. 3 showing mode of installation of enclosure beneath window.

FIG. 7 is a fragmentary cross-sectional view of the embodiment illustrated in FIG. 4, showing the preferred placement of the enclosure 16 beneath a windowsill 20 and attachment to an inside building wall 12 by means of lag screws 44 passing through the back wall 30 of the enclosure 16 and anchored into the structure of the inside building wall. It is preferred that the position of the lag screws is such that the enclosure 16 is anchored to support structures of the inside building wall 12, such as 2"×4" studs 52 or, as shown in FIG. 7, other support structures 54 in the building wall 12 beneath the windowsill 20.

Figure 8:
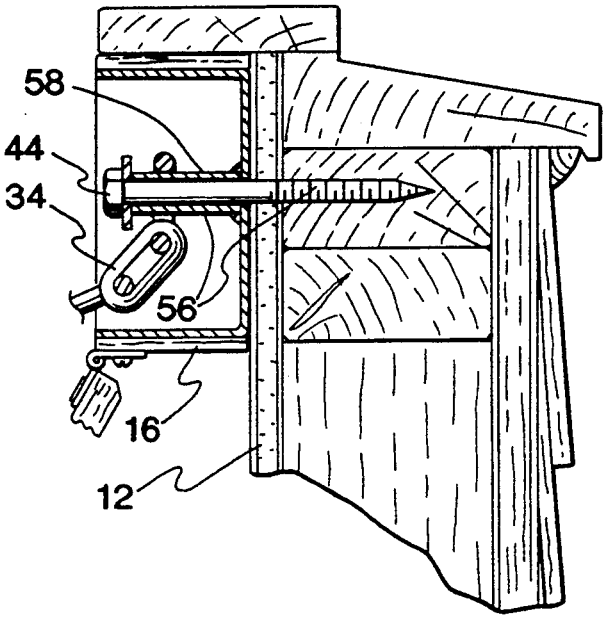
FIG. 8 is a cross-sectional view similar to that of FIG. 7 showing an alternative embodiment for attachment of the flexible support to the interior structure of the enclosure.

FIG. 8 illustrates an alternative embodiment in which the functions of a lag screw 44 and a spaced post 28 as shown in FIGS. 4, 6, and 7 have been combined in a single structure 56. In this embodiment, the chain 34 is attached to a hollow spaced post 58, through the central bore of which a lag screw 44 is positioned for anchorage into the adjacent building wall 12 as shown in FIG. 8. The position and mode of attachment of the chain 34 to the interior structure of the enclosure 16 can be suitably varied as dimensions of the enclosure 16 are varied to meet the aesthetic qualities of specific windows and inside building walls and to accommodate various lengths of flexible support.

Figure 9:
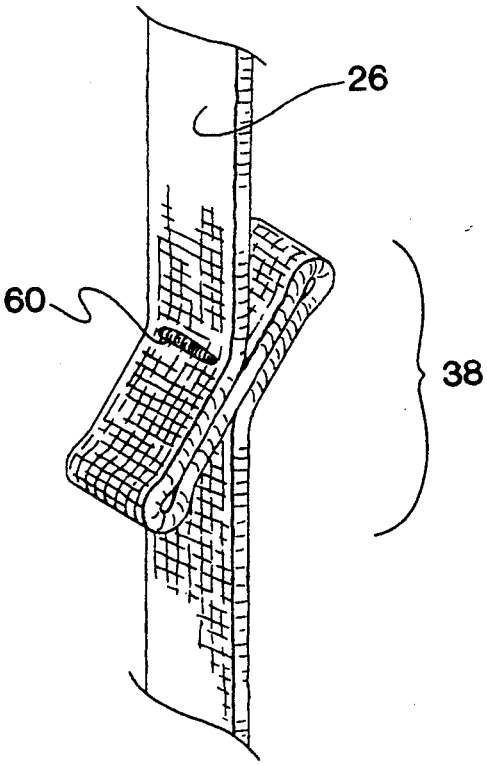
FIG. 9 is a fragmentary view of one embodiment of the flexible support, showing a gripping area.

To facilitate a controlled descent to a lower level window or to ground level, the flexible support 26 can be provided with structural features for gripping by the hands and feet. One embodiment of a gripping area 38 is shown in FIG. 3 and in FIG. 9. In this embodiment, a strap-like flexible support 26 is doubled back upon itself and secured in this configuration by heavy stitching 60. As shown in FIG. 3, such gripping areas 38 could be spaced at regular intervals along the length of the flexible support 26.

Figure 10:
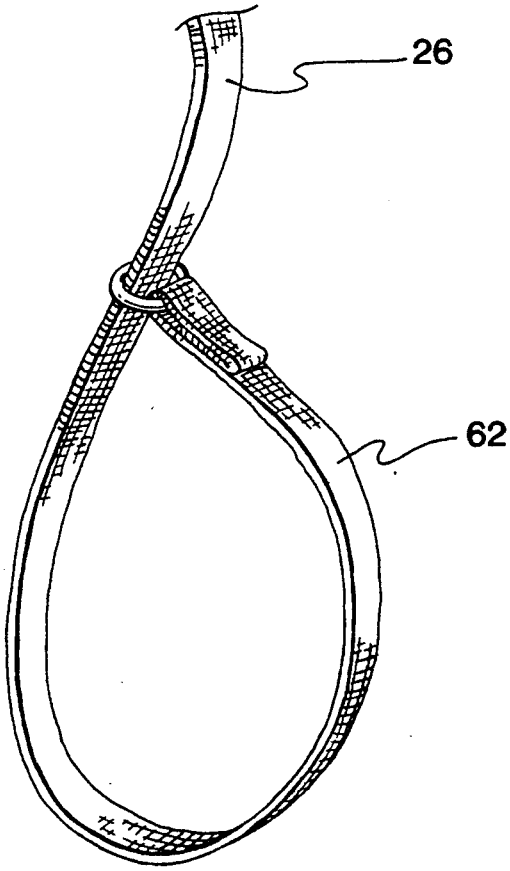
FIG. 10 is a fragmentary view of one embodiment of the flexible support, showing an adjustable loop at the distal end of the support.

The distal end of the flexible support 26 may be provided with an adjustable loop 62, as shown in FIG. 10. This loop could function as a harness, allowing infants, elderly persons or disabled persons to be lowered to safety.

While the present invention has been described in terms of preferred and other embodiments, it is understood that variations and modifications will occur to those skilled in the art. Therefore, it is intended that the appended claims cover all such equivalent variations which come within the scope of the invention as claimed.

What is claimed is:

1. An emergency escape device for assisting in escaping over the windowsill from a window situated above ground level in the wall of a building, under emergency conditions, said emergency escape device comprising:

(a) an enclosure having a top, bottom, sides, back and front, the interior top, interior bottom and interior side surfaces of said enclosure being lined by an embedded aluminum plate box for providing fire-proof support and rigidity to said enclosure, and wherein said front of said enclosure is hinged at its bottom edge allowing said front to remain in an upright, closed position when said enclosure is in a position of non-use, and to pivot downwardly to a vertical position below said enclosure when said enclosure is in, or is about to be placed in, a position of use, said enclosure being adapted for installation on the inside building wall below the frame of the window situated within said building wall, the horizontal distance spanned by said enclosure being greater than the distance from the left inner edge to the right inner edge of said window frame, and with the front of said enclosure facing the building interior;

(b) an elongated flexible rope- or strap-like support with a proximal end composed of steel cable or chain of sufficient length to reach the outside building wall said proximal end affixed to the middle portion of the interior back wall of said enclosure, and a distal end, said distal end provided with an adjustable loop adapted to circumscribe a human body, said support being wound, folded or otherwise packed within said enclosure when said support and said enclosure are in a position of non-use, and extending from said enclosure interior, over the windowsill, to the building exterior, and down the outside building wall when said support and said enclosure are in a position of use, said support being doubled back upon itself at resulting, spaced intervals and secured in such configuration by fastening means; and (c) spaced posts affixed to the interior back wall of said enclosure, said posts extending perpendicularly toward, but not reaching, the interior surface of the front wall of said enclosure, to thereby provide for storage of said support within said enclosure.

2. The emergency escape device of claim 1, wherein the top, bottom, sides, back and front of said enclosure are composed of wood.

* * * * *